US007111356B2

(12) United States Patent
Courtney et al.

(10) Patent No.: US 7,111,356 B2
(45) **Date of Patent: *Sep. 26, 2006**

(54) FLOOR CLEANING APPARATUS INCLUDING SELF-CLOSING DISPENSER FOR DISPENSING PARTICULATE CLEANING MATERIAL

(75) Inventors: Stephen Benjamin Courtney, Bath (GB); Matthew James Roger Allard, Bath (GB); Peter David Gammack, Bath (GB)

(73) Assignee: Dyson Technology Limited, (GB)

( * ) Notice: Subject to any disclaimer, the term of this patent is extended or adjusted under 35 U.S.C. 154(b) by 46 days.

This patent is subject to a terminal disclaimer.

(21) Appl. No.: 10/275,472

(22) PCT Filed: Apr. 25, 2001

(86) PCT No.: PCT/GB01/01837

§ 371 (c)(1),
(2), (4) Date: Aug. 4, 2003

(87) PCT Pub. No.: WO01/85006

PCT Pub. Date: Nov. 15, 2001

(65) Prior Publication Data

US 2004/0025284 A1 Feb. 12, 2004

(51) Int. Cl.
*A47L 9/00* (2006.01)

(52) U.S. Cl. ..... 15/320; 15/246.2

(58) Field of Classification Search ..... 15/320, 15/246.2, 328; 222/517, 287, 608, 619, 564
See application file for complete search history.

(56) References Cited

U.S. PATENT DOCUMENTS

| | | | | |
|---|---|---|---|---|
| 2,733,839 | A * | 2/1956 | Blum | 222/517 |
| 4,137,590 | A * | 2/1979 | Brown | 15/180 |
| 4,188,907 | A | 2/1980 | Lipani | |
| 4,268,935 | A | 5/1981 | Bessinger | |
| 4,471,891 | A | 9/1984 | Musschoot | |
| 4,512,057 | A | 4/1985 | Laing et al. | |
| 5,101,532 | A | 4/1992 | Dyson et al. | |
| 5,427,283 | A | 6/1995 | Whittaker et al. | |
| 6,626,085 | B1 * | 9/2003 | Lassota | 99/286 |

FOREIGN PATENT DOCUMENTS

GB 2 133 392 A1 7/1984

* cited by examiner

*Primary Examiner*—Theresa T. Snider
(74) *Attorney, Agent, or Firm*—Morrison & Foerster LLP

(57) ABSTRACT

A dispenser for dispensing particulate cleaning material onto a floor surface includes a hopper holding the particulate material and having a dispensing aperture defined by a part that is movable with respect to the hopper itself. This moving part also imparts movement toward the dispensing aperture of particulate cleaning material in the hopper. The dispenser may be attached to a floor cleaning apparatus and includes a biasing device that that biases the movable part into a position which closes the dispensing aperture when the dispenser is removed from the floor cleaning apparatus.

12 Claims, 6 Drawing Sheets

FLOOR CLEANING APPARATUS INCLUDING SELF-CLOSING DISPENSER FOR DISPENSING PARTICULATE CLEANING MATERIAL

FIELD OF THE INVENTION

This invention relates to a dispenser for dispensing particulate cleaning material onto a floor surface and to floor cleaning apparatus incorporating such a dispenser.

BACKGROUND OF THE INVENTION

Floor coverings such as carpets and rugs are prone to marks and stains. Floor coverings can be cleaned in a number of ways, which can be classified as 'wet' or 'dry' cleaning methods. Wet cleaning methods such as washing or shampooing the floor covering have the disadvantage that they can cause shrinkage of the floor covering. Dry cleaning generally involves depositing a powdered composition onto the floor covering which can readily absorb soil and contaminants from the floor covering. The powder is worked into the floor covering with the aid of a brush. Finally the dirty powder can then be removed from the floor covering by a vacuum cleaner. While such compositions are called 'dry', in that they flow as a powder at room temperature, they usually contain a quantity of liquid such as water or organic solvents.

The cleaning powder needs to be dispensed on to the floor covering. U.S. Pat. No. 4,268,935 and U.S. Pat. No. 5,101,532 describe powder-dispensing machines for use in cleaning carpets. In U.S. Pat. No. 5,101,532, a dispensing hopper is integrally formed as part of the machine for storing and dispensing dry-cleaning powder. At the front, lower part of the hopper there is a jaw which is formed by a lower flap which is hingedly fixed to the hopper. In use, the flap is oscillated about a mean gap width of around 4 mm so as to dispense powder onto the floor surface. The position of the lower flap is controlled by a user-operated control which moves the flap between one of two fixed positions: a dispense position, in which the flap is set to the 4 mm gap, and a grooming and vacuuming position in which the flap seals the hopper to prevent any powder escaping from the hopper. In use, the machine dispenses powder onto the floor surface at a controlled rate.

In the dispenser of U.S. Pat. No. 4,268,935 a powder dispenser is attachable to a vacuum cleaner. The dispenser has a hopper within which a metering drum is rotatably mounted to regulate the flow of powder from the hopper. A closure member is mounted within the hopper, downstream of the metering drum and just upstream of the discharge outlet. The closure member is manually operable between an open position in which powder may fall from the metering drum to the discharge outlet and a closed position in which the outlet is blocked.

A removable dispenser is convenient in that it only needs to be mounted on the cleaner when it is required. During normal cleaning the dispenser can be removed and stored without cluttering the cleaner. However, the use of a removable dispenser can cause some handling problems for inexperienced users. A user may not require all of the powder that they have poured into the dispenser with the result that the dispenser may still be partially filled with powder when it needs to be removed from the cleaner. Without careful handling there is a likelihood that powder will be spilled on to the floor surface. This results in dissatisfaction for a user.

SUMMARY OF THE INVENTION

The present invention seeks to provide a floor cleaning apparatus which is more convenient to use.

Accordingly, the present invention provides a dispenser for dispensing particulate cleaning material onto a floor surface comprising a hopper for holding the particulate material, a part of which hopper is movable with respect to the hopper to define a dispensing aperture and for imparting movement to particulate material in the hopper towards the dispensing aperture, the dispenser being removably attachable to a floor cleaning apparatus and wherein biasing means are provided for biasing the movable part into a position which closes the dispensing aperture when the dispenser is removed from the floor cleaning apparatus.

The dispensing aperture is closed whenever the dispenser is removed from the cleaning apparatus. Thus, a user does not spill cleaning material from the dispenser when they remove the dispenser from the cleaning apparatus, even when the dispenser still contains a considerable quantity of cleaning material.

In the closed position the dispensing aperture can be sealed tightly or it can be closed sufficiently to prevent cleaning material escaping from the dispenser.

The term 'floor surface' is intended to cover any type of floor covering such as carpet or a rug which may be present on the actual surface of the floor.

Preferably the movable part is pivotably mounted to the hopper and the biasing means acts on a portion of the movable part which is remote from the pivot. This provides a mechanical levering advantage which reduces the required strength of the biasing means.

Preferably the dispenser comprises separating means for separating particulate material in the region of the dispensing aperture. This helps to clear any clumps of particulate material which may form at the aperture, thus ensuring that particulate material is dispensed evenly. The separating means are located within the hopper, upstream of the aperture so that the separating means does not hinder the closing of the dispensing aperture.

The separating means can be carried by the movable part or by the fixed part of the hopper.

The dispenser can be provided as part of a floor cleaning apparatus, either as an integral part of the apparatus or as a removable attachment to the apparatus.

BRIEF DESCRIPTION OF THE DRAWINGS

Embodiments of the invention will now be described, by way of example only, with reference to the accompanying drawings in which.

DETAILED DESCRIPTION OF THE INVENTION

Figure 1:
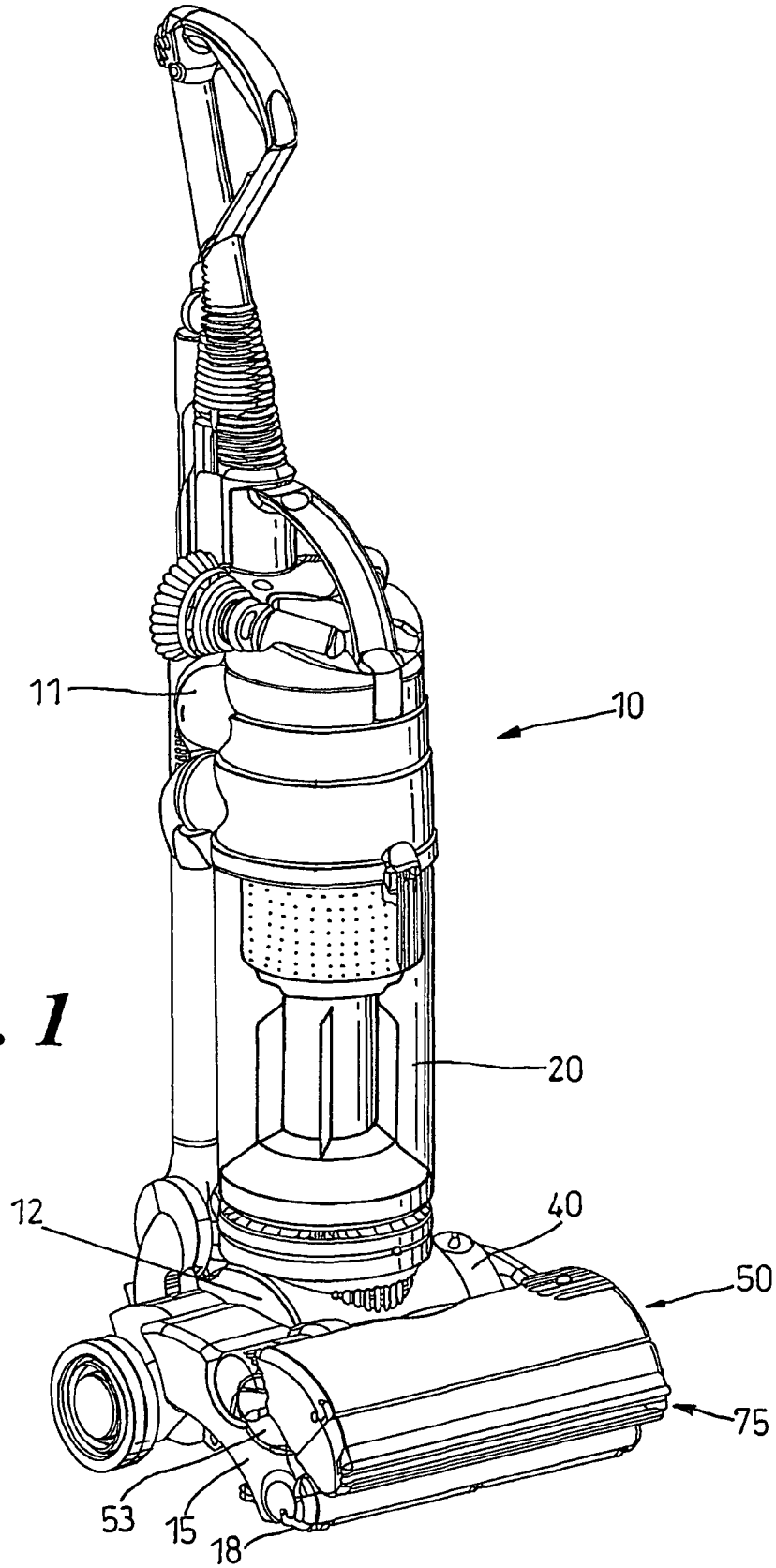
FIG. 1 shows a vacuum cleaner incorporating dispensing apparatus according to an embodiment of the invention.
Figure 2:
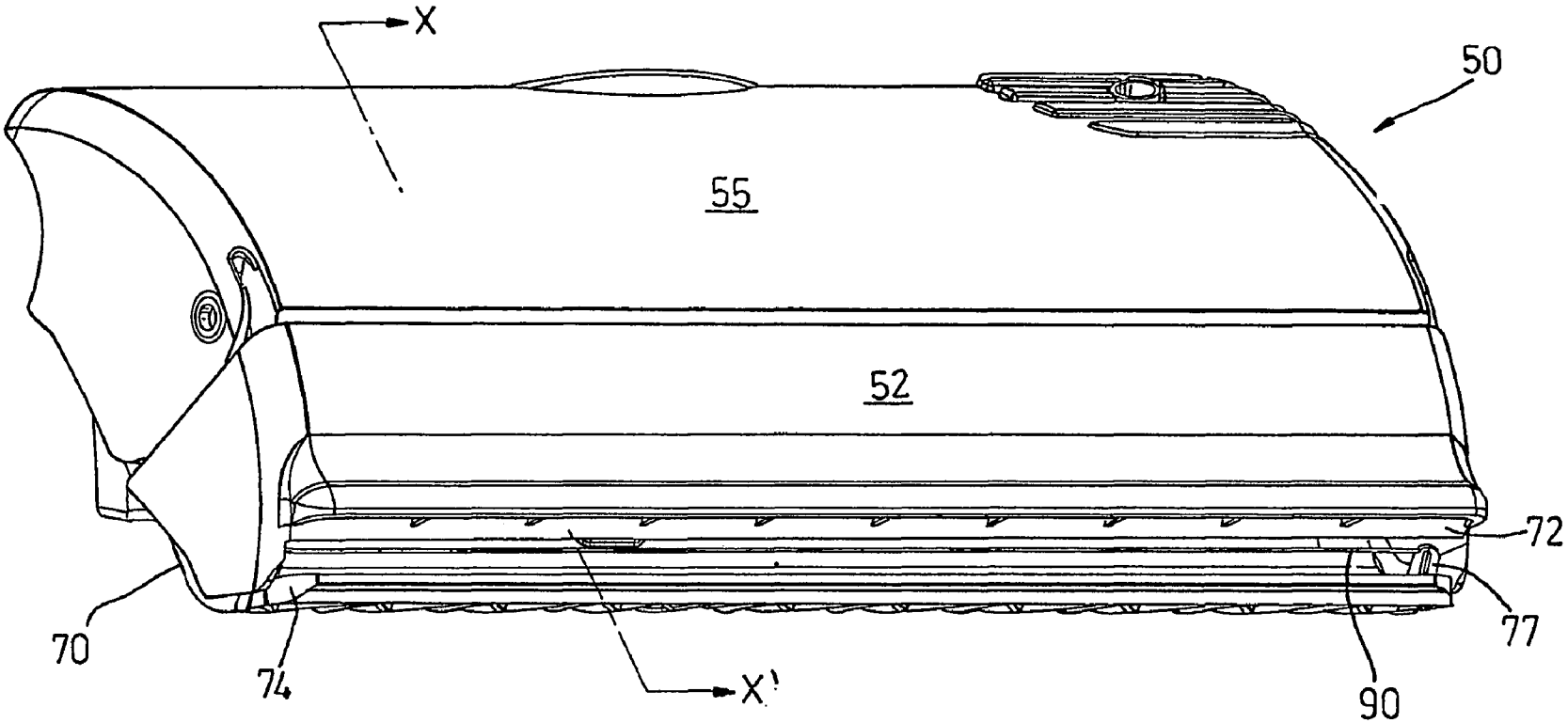
FIG. 2 shows the dispensing apparatus with the dispensing aperture open.

FIG. 1 shows a vacuum cleaner 10 which includes a dispenser 50 for dispensing particulate dry cleaning material onto a floor surface. The vacuum cleaner 10 is largely of a conventional design. The main body 11 has a motor housing 12 at its lower end. A cleaner head 15 is rotatably mounted to the motor housing to allow the cleaner head to remain in contact with the floor surface as the main body 11 is moved rearwardly into a normal operating position for upright cleaning. The cleaning head 15 includes an inlet 18 through which dirty air can be drawn into the cleaner and a brush bar for beating the floor surface. The main body 11 supports separating apparatus 20 which separates dirt and dust from the dirty air. The separating apparatus is preferably cyclonic separation apparatus using two cyclonic separation stages although it can take the form of a bag or other form of separator. Cyclonic separators have been found to be particularly effective at separating the dirty dry cleaning powder from the air drawn in to the cleaner 10. The separating apparatus 20 is removable from the main body 11 to allow the separating apparatus to be emptied.

Figure 3:
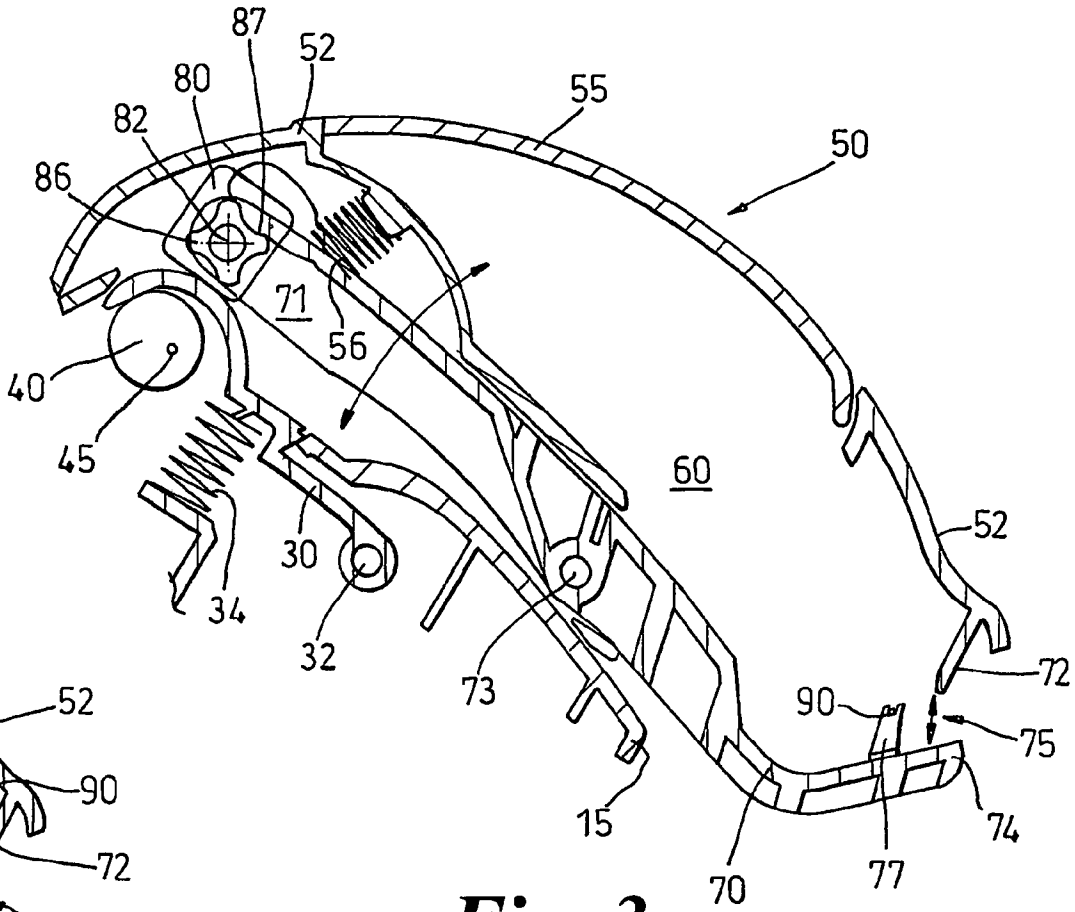
FIG. 3 is a cross-section through the dispensing apparatus of FIG. 2.

The vacuum cleaner 10 is modified with respect to a normal cleaner to support dispenser 50. The dispenser 50 is more clearly shown in FIGS. 2–10. The dispenser 50 fits onto the upper face of the cleaner head 15 and extends transversely across the cleaner head 15, parallel to the floor surface. A lug on each side of the dispenser 50 fits in a slot on each forward corner of the upper face of the cleaner head 15. These slots are shaped to allow the dispenser 50 to pivot from a generally upright position in which the dispenser 50 is inoperable to an operable position in which the dispenser 50 lies flush with the cleaner head 15. The dispenser 50 is shown in the operable position in FIG. 1. In the operable position an arm 53 on each side of the dispenser 50 fits in a recess on the side of the cleaner head 15 and a flange on the rear face of the dispenser 50 is received by a clamp on the cleaner head 15. The clamp is linked to a foot pedal 40 so that when a user presses on the foot pedal 40 the clamp is opened to release the dispenser 50. As shown in FIG. 3, the dispenser 50 comprises a hopper housing 52 whose rear face is defined by a plate 70 which is pivotally mounted to the housing 52 about an axle 73. The forward, upper face of the hopper is defined by a lid 55 which is pivotally mounted to the housing 52, the lid 55 opening from the uppermost end. The chamber 60 defined by the housing 52, plate 70 and lid 55 has a volume which is sufficient to receive a useful quantity of dry-cleaning powder. An arm 71 (best seen in FIG. 7) extends from the plate 70.

The cleaner head 15 includes a cam 40 for moving the arm 71 of the hopper plate 70 of the dispenser 50. The cam 40 is driven by way of the main motor (not shown) of the cleaner 10 and a drive shaft 45. The cam 40 is mounted inside the cleaner head 15, and a slot extends inwardly from the outer casing of the cleaner head towards the cam 40. A cam guard 30 is mounted within the slot and serves as both a cam follower and a guard. Cam guard 30 is pivotable about axle 32 and is normally biased, by spring 34, into a position in which it lies flush with the outer surface of the cleaner head 15. When the dispenser is mounted on the cleaner head 15, the cam guard 30 is pressed inwardly. against the spring 34, to lie against the cam 40 and can then follow the shape of the cam 40. The guard makes it impossible for a user or a child to trap a finger or an object between the cam and the casing, thus preventing injury to a user and damage to the cleaner.

The lower parts of the hopper plate 70 and housing 52 form a jaw which defines a dispensing aperture 75. The aperture is defined by a flange 72, which extends outwardly from the lower, forward part of housing 52, and end 74 of hopper plate 70. Plate 70 is driven by the cam 40 in the cleaner head 15, motion of the cam being transmitted to the plate 70 via the cam guard 30 and adjustment wheel 80. Motion of the plate 70 is constrained by spring 56 which fits between the plate 70 and housing 52. Plate 70 also carries a wire 90. The wire extends across the full width of the plate, parallel with the plate and the floor surface. The purpose of the wire 90 is to separate clumps of powder prior to the powder being dispensed onto the floor surface. Rapid movement of the plate 70, and therefore the wire 90, serves to cut through the powder.

Figure 4:
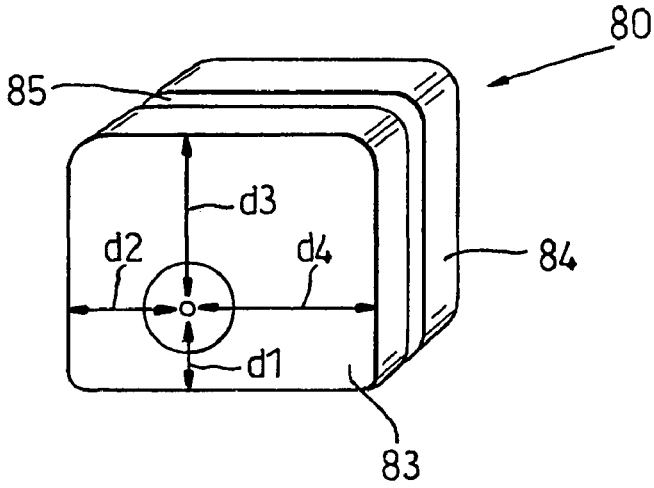
FIG. 4 shows the adjustable part of the dispensing apparatus of FIGS. 2 and 3.

In use, the width of aperture 75 will vary as the plate 70 is driven by the cam 40 in the cleaner head 15. Aperture 75 has a mean width, the width increasing or decreasing a small amount from this mean width as the plate 70 is driven. The mean width of the aperture has an effect on the rate at which powder is dispensed. The mean width of aperture 75 is controlled via adjustment wheel 80. Adjustment wheel 80 fits between the arm 71 and the cam guard 30 and, in addition to performing a cam following function, it controls the distance between these parts, which in turn controls the spacing between part 74 of plate 70 and flange 72, i.e. the width of the aperture 75. The adjustment wheel can be set in one of a number of different positions, each position providing a different distance between the cam guard 30 and plate 70. The adjustment wheel 80 is pivotably mounted about an axle 82 which is supported on arm 71. The wheel 80 has a different radius in different angular directions about the axle and is resiliently held in each of the differently dimensioned positions. FIG. 4 shows the wheel in more detail. The wheel is generally rectangular in shape and comprises two spaced apart members 83, 84 which are separated by a gap 85. The outer surface of the members 83, 84 is used to press against the cam follower of the cleaner head. The wheel 80 is mounted eccentrically about axle 82 to provide four differently dimensioned positions which are labelled in FIG. 4 as d1, d2, d3, d4. Within the gap 85 there is a spider-like part 86 which has the function of retaining the wheel 80 in the differently dimensioned positions. The spider 86 has four grooves around its outer surface which cooperate with a projection 87 carried by arm 71. The wheel can be snapped in to each of the positions by rotating wheel 80 against the resilience of projection 87. Each of the positions of the wheel are labelled, such as by numbering, to aid a user in selecting an appropriate setting for the dispenser. Typically, each setting of the adjustment wheel changes the mean width of aperture 75 by 1 mm.

Figure 5:
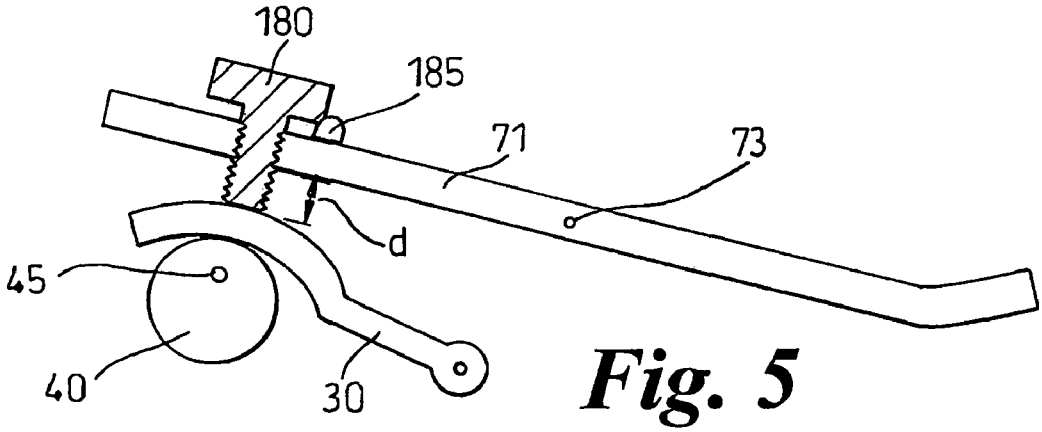
FIGS. 5 and 6 show alternative forms of the adjustable part of the dispensing apparatus of FIGS. 2 and 3.
Figure 6:
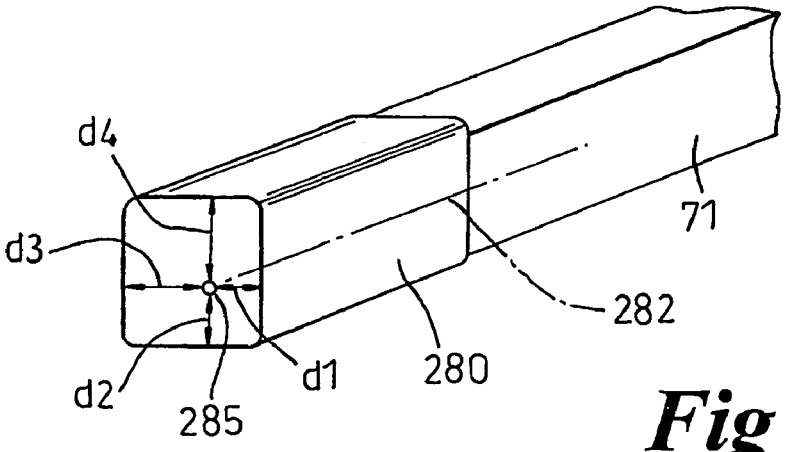

FIGS. 5 & 6 show alternatives to the adjustment wheel 80 which also achieve the same effect of varying the distance between the arm 71 and cam guard 30. In FIG. 5, an adjustment screw 180 is received in a threaded bore through the arm 71 of the hopper plate 70. By turning the screw, the distance d can be varied. In use, the rapid vibration of the arm 71 may cause the screw to rotate, thereby altering the distance d and the width of aperture 75. To prevent this rotation, the screw 180 has a tab 185 which engages with ribs on the upper surface of arm 71. Tab 185 can project radially outwardly from the head of the screw 180, axially between the screw head and the upper surface of the arm 71 or a combination of these, as shown in FIG. 5. In FIG. 6 part 280 of arm 71 represents the end of arm 71 which lies alongside the cam guard 30 of the cleaner head. Part 280 is rotatable with respect to the remainder of the arm 71 about axis 282. As with the adjustment wheel 80, part 280 is mounted eccentrically with respect to axis 282 so that each position of part 280 provides a different distance d1, d2, d3, d4 between the arm and the cam follower 30. In each of these embodiments it will be appreciated that the cam guard 30 could be omitted and the adjustment means itself, whether it is the adjustment wheel 80, adjustment screw 180 or rotatable part 280 directly follows the cam 40.

Figure 9:
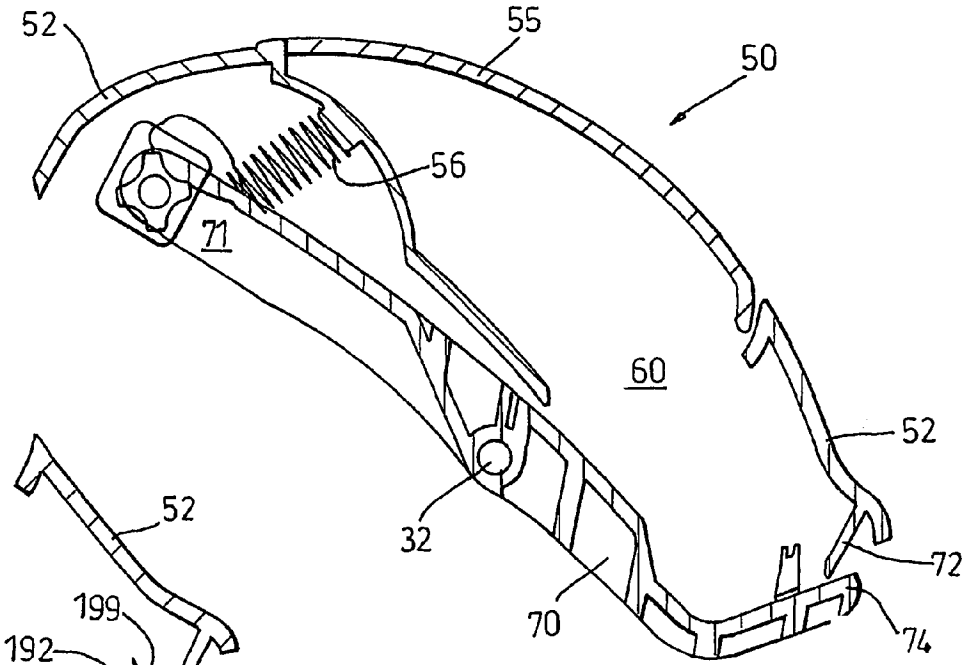
FIG. 9 is a cross-section through an alternative embodiment of the dispensing apparatus of the invention.

The dispenser 50 has a self-closing action. Spring 56 acts on arm 71 of the hopper plate 70 at all times. When the dispenser 50 is removed from the cleaner head, spring 56 acts on arm 71 so as to maintain plate 70 in a closed position where edge 74 of the plate 70 is sealed against, or rests closely to, the edge of flange 72. This prevents cleaning powder from escaping from the dispenser 50. This closed position is shown in FIG. 9. When the dispenser 50 is fitted to the cleaner head in preparation for use, arm 71 is urged upwards (as viewed in FIG. 3) against the bias of spring 56 which moves edge 74 of plate 70 away from flange 72 of the housing 52, thereby opening the dispensing aperture 75. The position of the wire 90 upstream of the flange 72 allows the plate 70 to properly close, while the wire still provides an effective separating action on powder at the aperture 75. The biasing action of spring 56 could be achieved with an alternative form of resilient device. The biasing action could also be achieved by positioning the spring in a different position to the one shown in FIG. 3. For example, a spring could be coiled around axle 73, the ends of the spring acting on the plate 70 and housing 52, although this alternative position loses the mechanical levering advantage that is gained from the position shown in FIG. 3.

As described above, a wire 90 extends across the dispenser 50 in the region of the dispensing aperture 75. A particularly effective separating action on the cleaning powder has been experienced using a wire having a diameter of 0.6 mm which is spaced from the plate 70 by a distance of 7 mm. However, it will be appreciated that a wire having a different diameter and separated from the plate by a different distance would also provide similar advantages. A braided wire has been found to offer the required durability although it is possible to use single strand wire. A synthetic cord such as Nylon would also be suitable.

Figure 7:
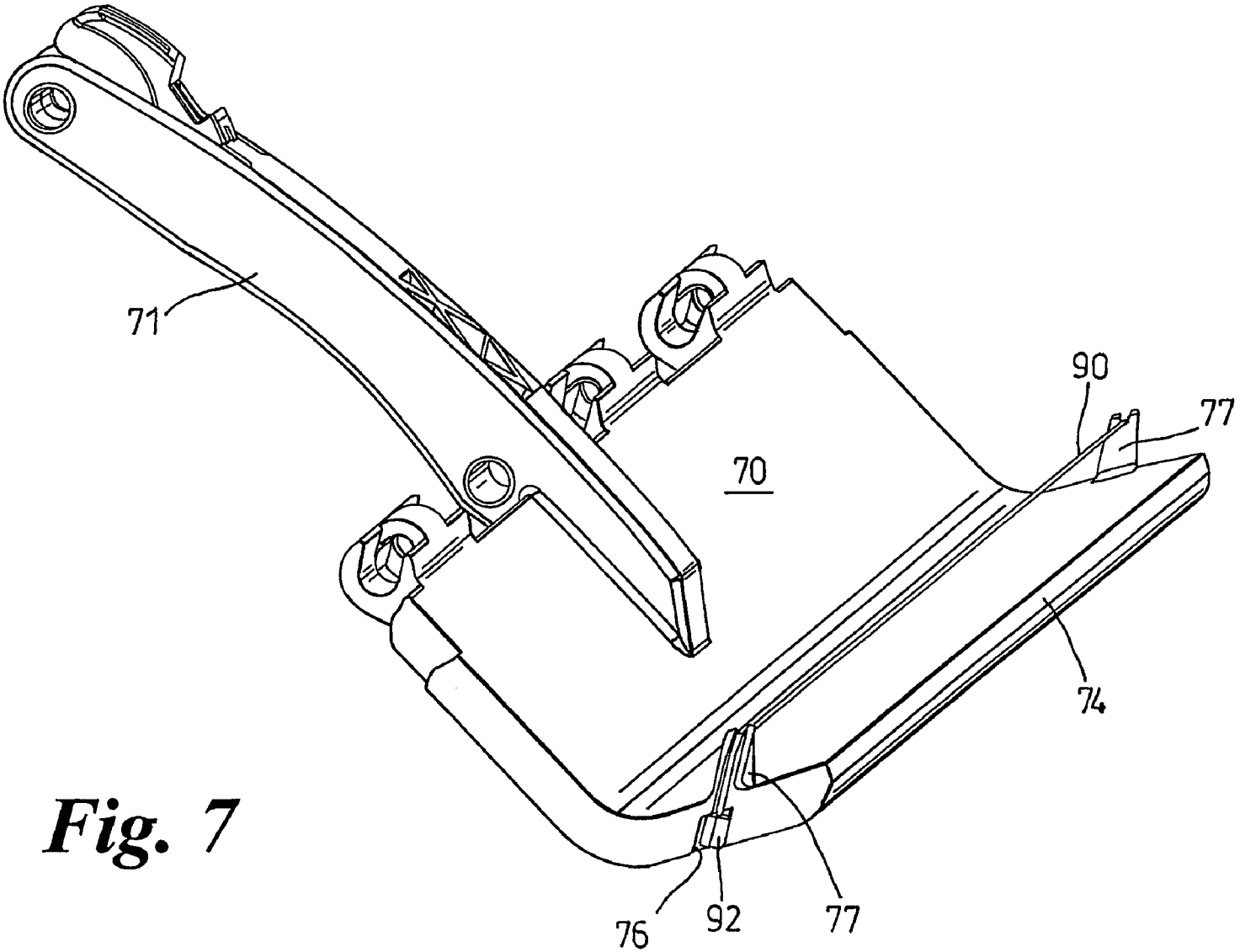
FIG. 7 shows just the dispensing plate of the dispensing apparatus of FIGS. 2 and 3.

FIG. 7 shows just the hopper plate 70 and the parts which fit to the plate. A ferrule 92 is crimped to each end of a length of wire 90. The ferrule 92 is retained in a recess 76 on each side of the hopper plate 70. The wire 90 is spaced from the surface of the plate 70 by supports 77 which extend outwardly from the plate 70 into the chamber 60. The outer surface of each support is grooved so as to retain the wire 90 in position. The wire 90 is of such a length that it is retained under tension between the supports 77. This ensures that the wire is taut at all times, which improves the cutting action of the wire 90 on the cleaning powder.

Figure 8:
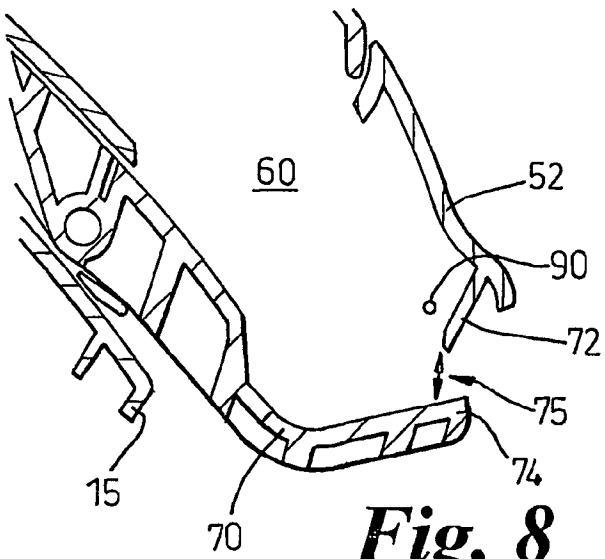
FIG. 8 shows an alternative position for the separating means.

While the wire has been found to be particularly effective when it is carried by the plate 70, it could alternatively be attached to each side of the housing 52 near to the flange 72, as shown in FIG. 8. In this alternative embodiment, any clumps of powder on the plate 70 are moved upwardly towards the wire where they are separated by the fixed wire. While a single wire 80 is shown in the Figures, it is possible to use two or more wires which are spaced apart perpendicularly from the surface of plate 70 or laterally along the plate 70.

Figure 10:
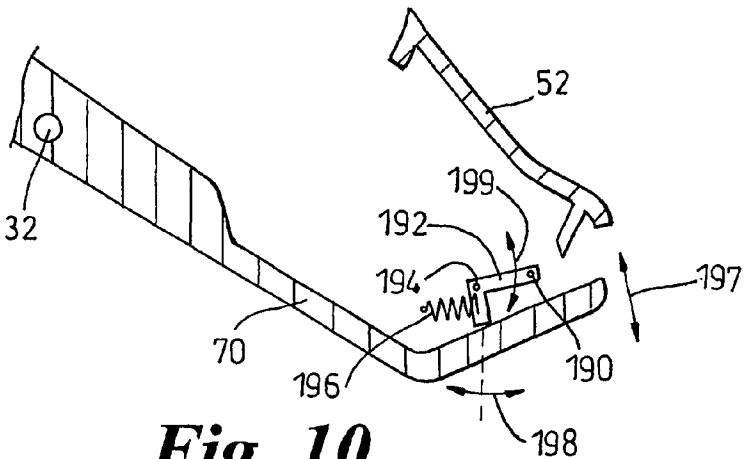
FIG. 10 shows an alternative arrangement to the fixed wire.

A further alternative to the fixed wire is shown in FIG. 10. An L-shaped part 192 is pivotably mounted to each side of the hopper housing 52. A wire 190 is secured to each of the parts 192. One of the arms of parts 192 is biased by spring 196 so that it rests against the surface of hopper plate 70. Movement of the hopper plate 70, shown as 197, causes the parts 192 to move in the manner shown by arrow 198, which in turn causes the wire 190 to move in the manner shown by arrow 199. Thus, movement of the hopper plate 70 causes wire 190 to perform a cutting action. By appropriate selection of the lengths of the two L-shaped arms of part 192, a levering advantage is gained, such that a small movement of the hopper plate 70 is converted into a larger movement of wire 190. The arm which contacts the plate 70 is shorter than the arm which carries the wire 190. As an alternative to using a wire, a cord, blade or some other material which provides a cutting action could be used.

The operation of the cleaner will now be described. To fill the dispenser 50, a user opens the lid 55 and pours cleaning powder into the hopper, filling chamber 60 of the hopper. The cleaner is operable in the following modes: dispense, groom and vacuum.

In dispense mode, the cleaner operates to dispense cleaning powder from the dispensing hopper 50. Dispenser 50 is fitted to the cleaner head 15. The separating apparatus 12 is removed from the main body 11 of the cleaner 10. The cleaner detects the removal of the separating apparatus 12 and turns off the suction fan (not shown). Alternative means can be used to control the cleaner to turn off the suction fan, such as by a manually operated control switch or a switch which is responsive to the position of the dispensing apparatus on the cleaner head. A user pushes the hopper 50 so that it is grasped by the clamp on the cleaner head 15. In this position, plate 70 and adjustment wheel 80 press against cam guard 30 and the cam guard 30 is pressed into an operational position against the cam 40 in the cleaning head 15. Plate 70 is moved, against the action of the spring 56, into a dispensing position in which dispensing aperture 75 is open. When operated, the cleaner head cam 40 rotates, causing plate 70 to vibrate at high speed. Typically, the plate vibrates at a rate of around 3000 rpm. Vibration of the plate 70 agitates powder in the cleaning dispenser and causes the powder to move downwardly towards dispensing aperture 75. Flange 72 at the dispensing jaw regulates the flow of powder from the dispenser. Wire 90, carried by plate 70, serves to separate the powder before it is dispensed, thus preventing clumps from being dispensed or from forming in the dispensing aperture 75. A user pushes the cleaner across the floor surface where they require cleaning and powder is dispensed from hopper 50 through aperture 75 on to the floor surface in an even and controlled manner.

In groom mode, the cleaner operates to brush the dispensed powder into the floor covering, with the brush bar in the cleaner head 15 operating at a reduced speed to achieve this grooming action. The user operates foot pedal 40 and lifts the dispenser 50 forwardly from the clamp. As soon as the dispenser is lifted, plate 70 moves under the bias of spring 56 into a position in which it closes the dispensing aperture 75. The dispenser can sit on the cleaner head 15 in this inoperable position or it can be removed. In either case, the dispensing aperture 75 remains closed. The user moves the cleaner across the region of the floor surface where powder was dispensed so as to groom the powder into the carpet. If a user finds that they have not properly covered the floor surface with cleaning powder and would like to dispense more cleaning powder, they can push the dispenser 50 into the engaged position on the cleaner head, whereby plate 70 moves to open dispensing aperture 75 and the dispenser will function.

In vacuum mode the cleaner operates in a conventional manner to draw dirty air into the cleaner via the cleaner head 15. The dispenser 50 can be used in its inoperable position or it can be removed from the cleaner, as described above for groom mode. The separation apparatus 12 is returned to an operational position on the main body 12 of the cleaner. The user moves the cleaner across the region of the floor surface where powder has been dispensed and groomed. The brush bar operates at normal speed and serves to agitate the floor covering. A combination of the agitation and the vacuum serve to draw dirty cleaning powder from the floor covering and into the cleaner 10 via the cleaning head 15. The separating apparatus 12 separates the dirty powder from the air and exhausts cleaned air to the atmosphere.

Variations will be apparent to a person skilled in the art and are intended to fall within the scope of the present invention.

The invention claimed is:

1. A dispenser for dispensing particulate cleaning material onto a floor surface, comprising a hopper for holding the particulate cleaning material and a movable part which is movable with respect to the hopper to define a dispensing aperture as a gap between an opening portion of the hopper and the movable part and to impart movement to particulate cleaning material in the hopper towards the dispensing aperture, the dispenser being removably attached to a floor cleaning apparatus and comprising a biasing device that biases the movable part into a position which closes the dispensing aperture when the dispenser is removed from the floor cleaning apparatus.

2. The dispenser according to claim 1, wherein the movable part comprises a cam follower configured for cooperating with a cam on the floor cleaning apparatus to move the movable part, the movable part being movable against the action of the biasing device to open the dispensing aperture when the dispenser is attached to the floor cleaning apparatus.

3. The dispenser according to claim 1, wherein the movable part is mounted to the hopper by a pivot and the biasing device acts on a portion of the movable part which is remote from the pivot.

4. The dispenser according to claim 1, wherein the biasing device acts between the movable part and a wall of the hopper.

5. The dispenser according to claim 1, further comprising a separator for separating particulate cleaning material at the dispensing aperture, the separator being located within the hopper upstream of the dispensing aperture.

6. A dispenser according to claim 5 wherein the separating is carried by the movable part.

7. A dispenser according to claim 6 wherein the separating is a wire.

8. The dispenser according to claim 1, 2, 3, 4, 5, 6 or 7, further comprising a flange located at the dispensing aperture and extending outwardly from the hopper towards the movable part, the biasing device acting to bring the movable part into a position where the movable part rests near an edge of the flange.

9. A floor cleaning apparatus comprising a main body, a cleaner head and the dispenser according to claim 1, 2, 3, 4, 5 or 6 on the cleaner head.

10. The floor cleaning apparatus according to claim 9, further comprising a drive mechanism, wherein the dispenser is movable between an operable position in which it is attached to the floor cleaning apparatus and engages with the drive mechanism on the floor cleaning apparatus and an inoperable position in which it is attached to the floor cleaning apparatus but is disengaged from the drive mechanism and wherein the biasing device biases the movable part into a position which closes the dispensing aperture when the dispenser is in the inoperable position.

11. The floor cleaning apparatus according to claim 10, wherein the drive mechanism drives the movable part in an oscillatory manner.

12. A vacuum cleaner comprising a main body, a cleaner head a drive mechanism and the dispenser according to claim 1, 2, 3, 4, 5, 6 or 7 on the cleaner head, wherein the dispenser is movable between an operable position in which it is attached to the vacuum cleaner and engages with the drive mechanism on the vacuum cleaner and an inoperable position in which it is attached to the vacuum cleaner but is disengaged from the drive mechanism and wherein the biasing device biases the movable part into a position which closes the dispensing aperture when the dispenser is in the inoperable position.

* * * * *

UNITED STATES PATENT AND TRADEMARK OFFICE

CERTIFICATE OF CORRECTION

PATENT NO. : 7,111,356 B2
APPLICATION NO. : 10/275472
DATED : September 26, 2006
INVENTOR(S) : Stephen B. Courtney et al.

It is certified that error appears in the above-identified patent and that said Letters Patent is hereby corrected as shown below:

In the claims:

In Column 8, line 5, Claim 6, delete "A" and replace with --The--;

After "claim 5" add --,--; and

Delete "separating" and replace with --separator--

In Column 8, line 7, Claim 7, delete "A" and replace with --The--;

After "claim 6" add --,--; and

Delete "separating" and replace with --separator--

Signed and Sealed this

Sixth Day of March, 2007

JON W. DUDAS
*Director of the United States Patent and Trademark Office*